US011559454B2

(12) United States Patent
Esworthy

(10) Patent No.: US 11,559,454 B2
(45) Date of Patent: Jan. 24, 2023

(54) ROTATIONAL SUPPORT APPARATUS

(71) Applicant: Walker-Go-Round Medical Supply, LLC, Coatsville, PA (US)

(72) Inventor: James Bryan Esworthy, Coatsville, PA (US)

(73) Assignee: Walker-Go-Round Medical Supply, LLC, Coatesville, PA (US)

( * ) Notice: Subject to any disclaimer, the term of this patent is extended or adjusted under 35 U.S.C. 154(b) by 563 days.

(21) Appl. No.: 16/580,381

(22) Filed: Sep. 24, 2019

(65) Prior Publication Data

US 2020/0146914 A1 May 14, 2020

Related U.S. Application Data

(60) Provisional application No. 62/735,281, filed on Sep. 24, 2018.

(51) Int. Cl.
*A61G 7/10* (2006.01)

(52) U.S. Cl.
CPC ..... *A61G 7/1076* (2013.01); *A61G 7/1038* (2013.01); *A61G 7/1046* (2013.01); *A61G 7/1086* (2013.01); *A61G 2200/34* (2013.01); *A61G 2200/36* (2013.01)

(58) Field of Classification Search
CPC combination set(s) only.
See application file for complete search history.

(56) References Cited

U.S. PATENT DOCUMENTS 4,829,612 A * 5/1989 Adams ..... A61G 7/1076 5/81.1 RP
5,507,044 A * 4/1996 Williamson ..... A61G 7/1046 5/81.1 RP
5,524,303 A 6/1996 Palmer, Jr. et al.
5,526,541 A * 6/1996 Massey ..... A61G 7/1098 5/81.1 RP
7,543,341 B1 * 6/2009 Carbaugh ..... A61G 7/1076 5/81.1 RP
9,345,631 B2 * 5/2016 Daneshvar ..... A61G 7/1098
10,092,469 B1 * 10/2018 Lillevold ..... A61G 7/1038
10,682,275 B2 * 6/2020 Richard ..... A61G 7/1034
10,987,266 B2 * 4/2021 Domenick ..... A61G 7/1051
2005/0076436 A1 * 4/2005 Hahn ..... A61G 7/1046 5/81.1 R
2010/0319121 A1 * 12/2010 Polomsky ..... A61G 7/1076 5/81.1 RP
2013/0269102 A1 * 10/2013 Raven ..... A61G 5/14 5/81.1 RP
2015/0250674 A1 * 9/2015 Moore ..... A61G 7/1044 135/65
2018/0161224 A1 * 6/2018 Forro ..... A61G 7/053
2019/0038490 A1 * 2/2019 Lillevold ..... A47B 91/005

* cited by examiner

*Primary Examiner* — Monica E Millner

(74) *Attorney, Agent, or Firm* — Penn State Law IP Clinic

(57) ABSTRACT

Moving an individual with limited mobility from one seated position to another requires a significant effort from the caregiver and can expose the individual and the caregiver to several injuries. The rotational support apparatus is useful in safely assisting individuals with limited mobility to move from one seated position to another with minimal effort. The apparatus is lightweight and portable. The base of the apparatus rotates so the caregiver can easily move the position of the individual. The base can be coupled with a stabilizing device that the individual with limited mobility can hold on to while the caregiver rotates them to another position.

12 Claims, 12 Drawing Sheets

ROTATIONAL SUPPORT APPARATUS

CROSS-REFERENCE

This application claims the benefit of U.S. Provisional Application No. 62/735,281, filed Sep. 24, 2018, which application is incorporated herein by reference.

BACKGROUND OF THE INVENTION

Caring for an individual with limited mobility can present numerous difficulties. One such difficulty occurs when a caregiver needs to move an individual with limited mobility from one seated position to another. This commonly occurs when a caregiver needs to transfer an individual with limited mobility from a bed or a seat to a wheelchair.

In such situations, the caregiver generally has two options to perform the transfer. First, the caregiver can move the individual using only the caregiver's own body strength. For example, the caregiver can entirely lift the individual with limited mobility from the first seated position and place them into the second seated position. The caregiver can also lean the individual against the caregiver's own body and rotate the individual into the second seated position. Using the caregiver's own body strength, however, exposes the caregiver to the possibility of injuring themselves during the transfer. Also, if the caregiver loses their balance or has a loss of strength, they can injure the individual with limited mobility.

Second, the caregiver can use a small rotating disk to assist with moving an individual with limited mobility. In such a case, the caregiver places the disk on the ground, has the individual place their feet on the disk and rise to a standing position with the caregiver's assistance. The caregiver then rotates the individual's body and returns them to a seated posture in the second position. These disks, however, are often difficult for individuals to balance on, so the caregiver must still depend upon their own body strength in order to help the individual maintain balance and rotate the individual.

In both situations, a caregiver is required to use their own body strength. This means that caregivers need a certain amount of strength in order to be able to assist an individual with limited mobility. Such a prerequisite makes it difficult for smaller caretakers to assist more sizable individuals. In many instances, families are required to hire outside help that has the requisite strength, which can pose a significant financial burden.

Caregiver injuries result in not only personal injury but also, loss of wages, loss of work where the individual could provide care for others and could result in a worker's compensation case.

SUMMARY OF THE INVENTION

In some embodiments, the invention is a portable movement assistance device comprising: a handle, wherein said handle is configured to accommodate the lifting and transfer of said device by a grip of a human hand; a platform, wherein the size of said platform is sufficient in size to accommodate a walker and a human using said walker; a base, wherein said base is configured to be placed on a floor; and a rotational component, wherein said rotational component contacts said base and said platform; and is configured to provide a rotational mechanism between said base and said platform; wherein said device is configured to rotate a human in a circular motion along a circular path. In one aspect the portable movement device is configured to be portable from a first location to a second location. In one aspect the portable movement device weighs less than 30 pounds. In one aspect the portable movement device weighs less than 20 pounds. In one aspect the portable movement device comprises wheels to move said device from a first location to a second location. In one aspect the portable movement device has a platform that further comprises an anti-slip surface. In one aspect the portable movement device has a platform configured to stably accommodate a walker. In one aspect the portable movement device further comprises one or more engageable walker clasps that when engaged are configured to clasp to a walker and immobilize the walker in a stationary position. In one aspect the portable movement device has a platform that is configured to assist a person to rise from a first seated position to a standing position, rotate said person to a desired location and assist said person to a second seated position. In one aspect the portable movement device is configured to assist a person that weighs over 350 pounds. In one aspect the portable movement device has a rotational component comprises a lazy Susan mechanism. In one aspect the portable movement device can be rotated by a caregiver. In one aspect the portable movement device can be transported by a caregiver.

In some embodiments the invention is a method of moving a person with mobility constraints, the method comprising: placing a walker onto a platform of a portable movement device; assisting the person with mobility constraints from a first seated position near said portable movement device, to a standing position on said portable movement device, wherein said person with mobility constraints engages one or more handles on said walker on said platform of said portable movement device to stand in an assisted position on said portable movement device; rotating said platform of said portable movement device relative to a base of said portable movement device, wherein said base of said portable movement device is stably positioned on a floor and wherein said person with mobility constraints is rotated in a circular motion in a circular path to a second position; assisting said person with mobility constraints to a second seated position; and removing said walker from said portable movement device. In one aspect the method further comprising moving said portable movement device to a second location. In one aspect the portable movement device is less than 30 pounds. In one aspect the portable movement device is less than 20 pounds. In one aspect the portable movement device is configured to accommodate a person with mobility constraints that weighs over 350 pounds. In one aspect the platform is engaged with said base with a rotational component. In one aspect the method of rotational component is a lazy Susan.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

The present disclosure describes a rotational support apparatus that addresses many of the issues described above. The apparatus includes a broad base on which an individual with limited mobility can stand on and be rotated by a caregiver. The apparatus can work in tandem with a walker or have its own built-in handles to support the individual's weight while the caregiver rotates the apparatus.

Figure 1:
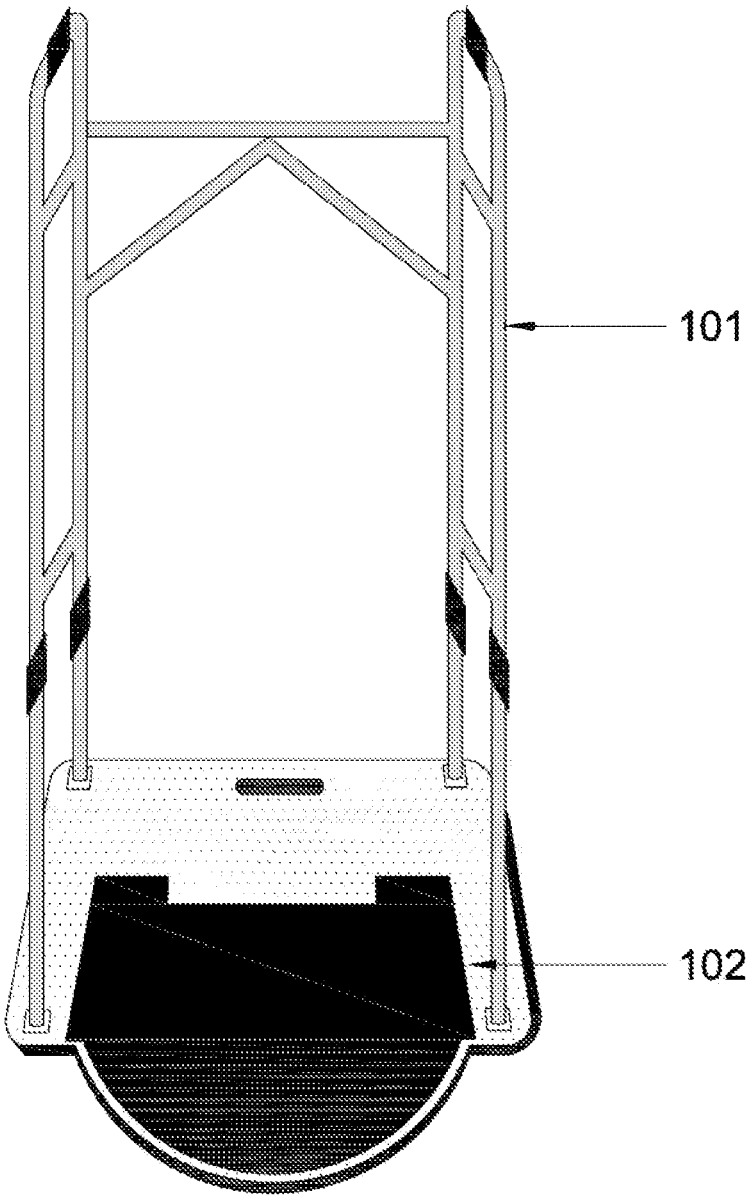
FIG. 1 illustrates the rear isometric view of an embodiment of the apparatus.

In one embodiment, shown in FIG. 1, the apparatus includes a base (102) that can couple to a stabilizing device such as a walker (101). The apparatus couples to a stabilizing device on the top surface of the base.

Figure 2:
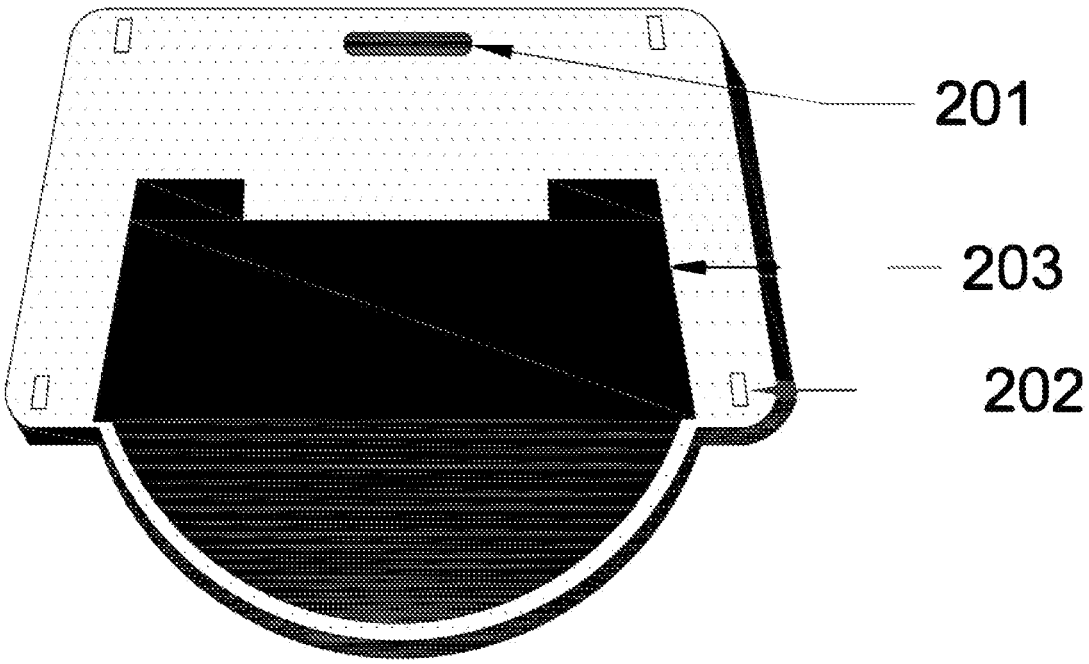
FIG. 2 illustrates the top view of the base of the apparatus.

As shown in FIG. 2, one embodiment can use walker-skis (202) that have been attached to the top surface of the base in order to couple to the stabilizing device. The top surface of the base has a non-slip coating (203) to prevent an individual from slipping. The base comes with a handle (201) to make the apparatus portable.

In the case where the stabilizing device is a walker, the walker-skis should be positioned such that the legs of walker are coupled near the edge of the base in order to maximize stability. The stabilizing device can be coupled to the base in numerous ways, including but not limited to a push-button mechanism, a locking button device, pins, clips, clamps or screw fasteners.

The top surface of the apparatus can include a non-slip coating such as grip tape. This non-slip coating helps prevent an individual using the apparatus from slipping while on the apparatus. One skilled in the art would recognize that several non-slip coatings would also be appropriate to prevent slippage.

Figure 3:
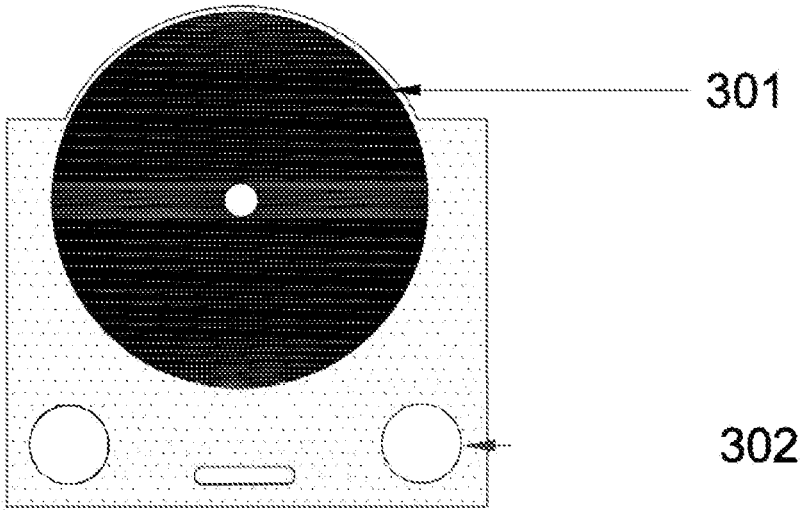
FIG. 3 illustrates the bottom view of the base of the apparatus.

In an embodiment, shown in FIG. 3, the bottom surface of the base includes a rotational platform (301) and non-stick support surfaces (302). The rotational platform should be positioned in line with where an individual using the apparatus would be standing so that the individual's center of gravity is on the rotational axis. Positioning the rotational platform in such a manner reduces the likelihood that an individual using the apparatus would fall. The rotational platform can include a surface configured to grip a floor surface. This surface can be composed of several types of materials including but not limited to grip tape or rubber.

The non-stick supports are configured so as to maximize ease of rotation while using the apparatus. In one instance, furniture mover pads can be employed as non-stick supports. In another instance, the bottom surface of the base is completely composed of a non-stick material with the exception of the rotational platform. One skilled in the art would recognize that numerous types of non-stick materials would be appropriate for such a use.

Figure 4:
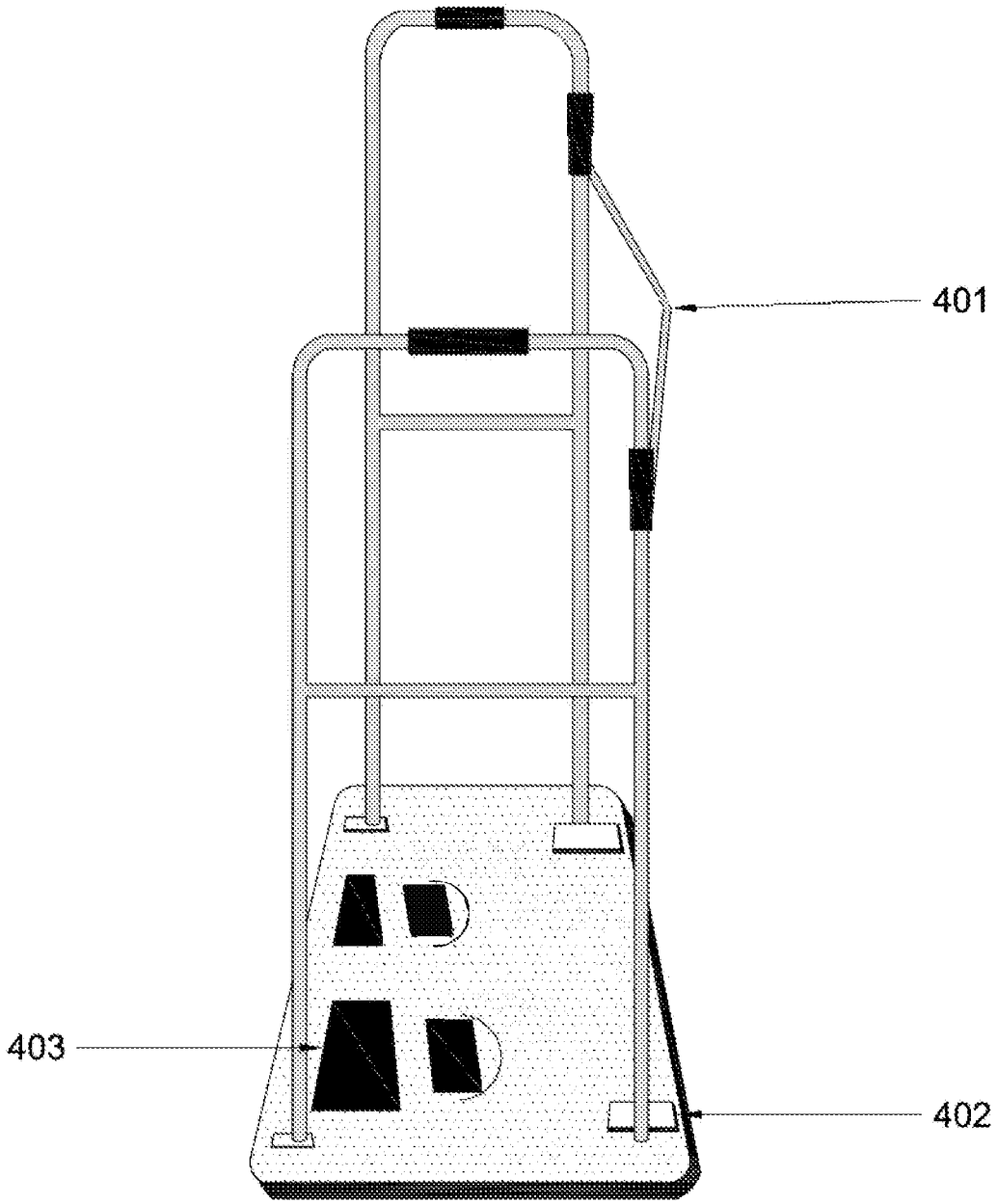
FIG. 4 illustrates the side isometric view of an embodiment of the apparatus.

In an embodiment, shown in FIG. 4, the base (402) can include reduced amount of non-slip coating (403). The base using reduced amount of non-slip coating can be coupled with a stabilizing device (401) such as a walker.

Figure 5:
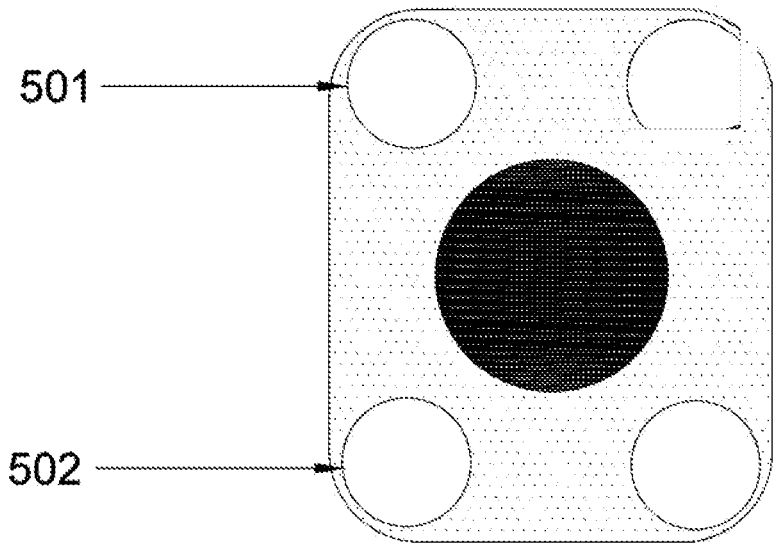
FIG. 5 illustrates the bottom view of the apparatus customized for a sizeable individual.

In another embodiment, the apparatus is configured to allow a sizable individual to make use of the apparatus. As shown in FIG. 5, the increased size of the apparatus may require an increased number of non-stick supports on the base (501,502).

Figure 11:
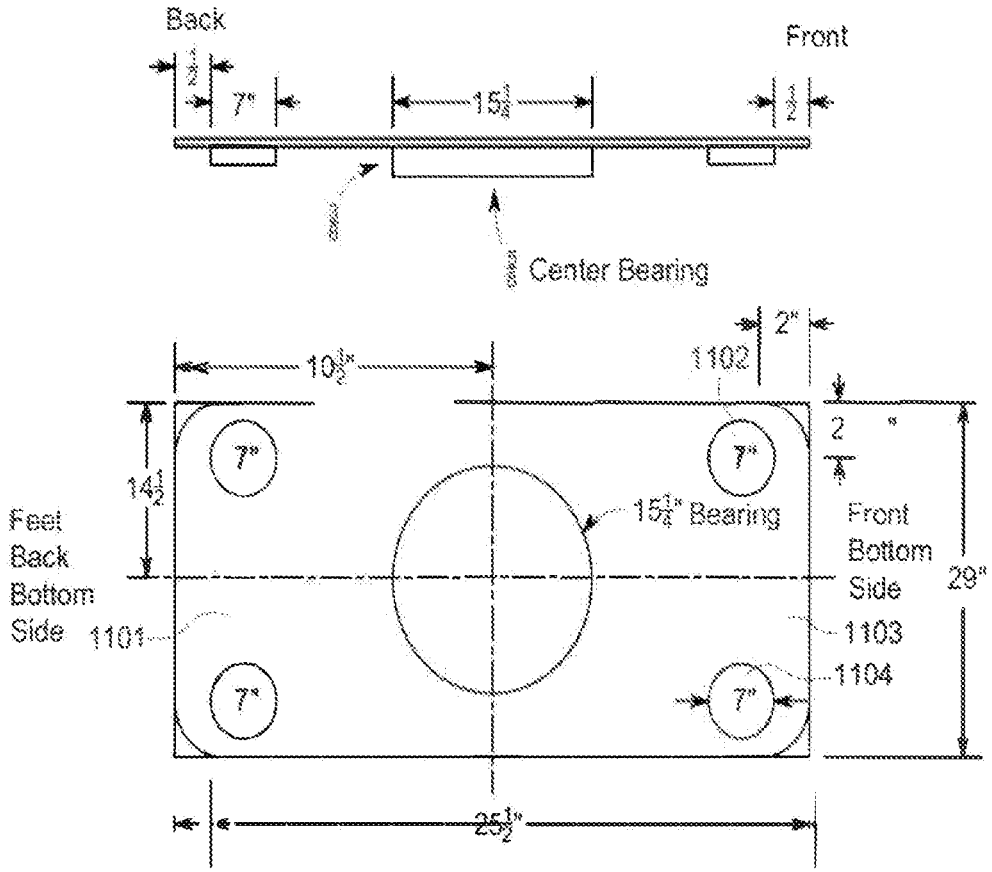
FIG. 11 illustrates drawing of the side and bottom view of an embodiment of a large apparatus.

In an embodiment, shown in FIG. 11, the size of the base can be increased to accommodate a sizeable individual. The back-bottom side of the base (1101) and the front bottom side (1103) can be increased in length and width according to the requirements of the individual. Additional number or non-stick supports (1102,1104) can be added to the base of the apparatus.

Figure 12:
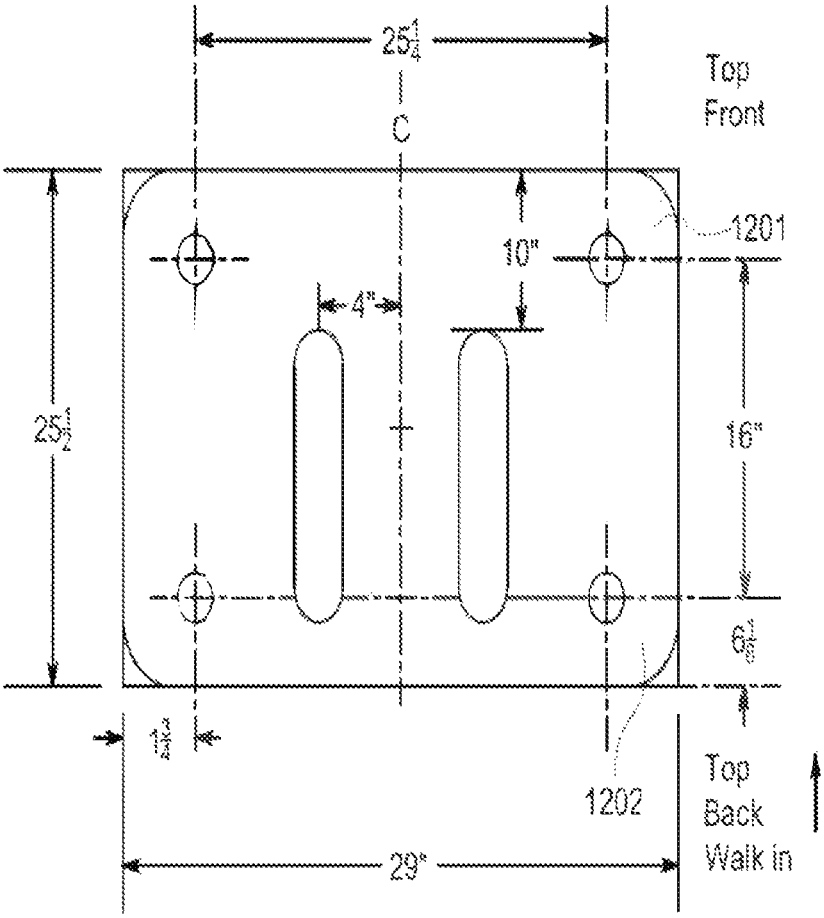
FIG. 12 illustrates drawing of the top view of an embodiment of a large apparatus.

In an embodiment, shown in FIG. 12, the size of the base can be increased to accommodate a sizeable individual. The top front side (1201) and the top back side (1202) of the apparatus can be increased in length and width according to the requirements of the individual.

Figure 10:
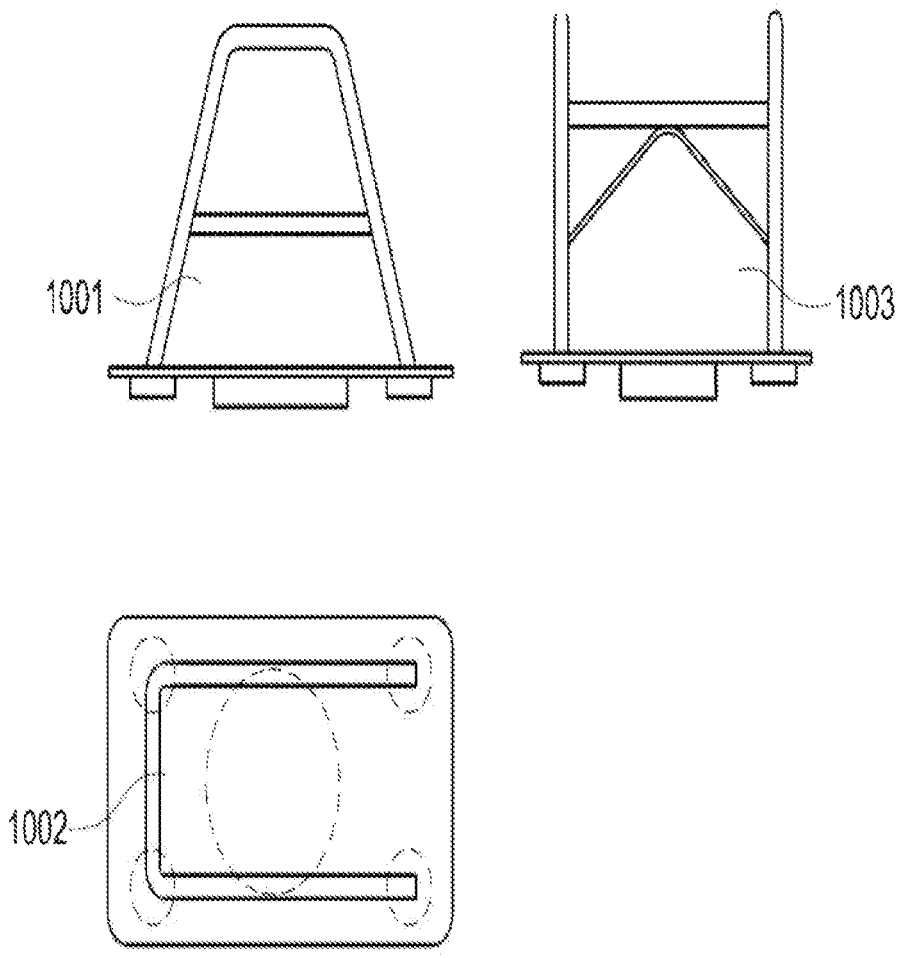
FIG. 10 illustrates drawing of an embodiment of the apparatus.

In an embodiment, shown in FIG. 10, the base for a sizeable individual (1002) can be coupled with numerous types stabilizing devices such as a walker (1001,1003).

Figure 6:
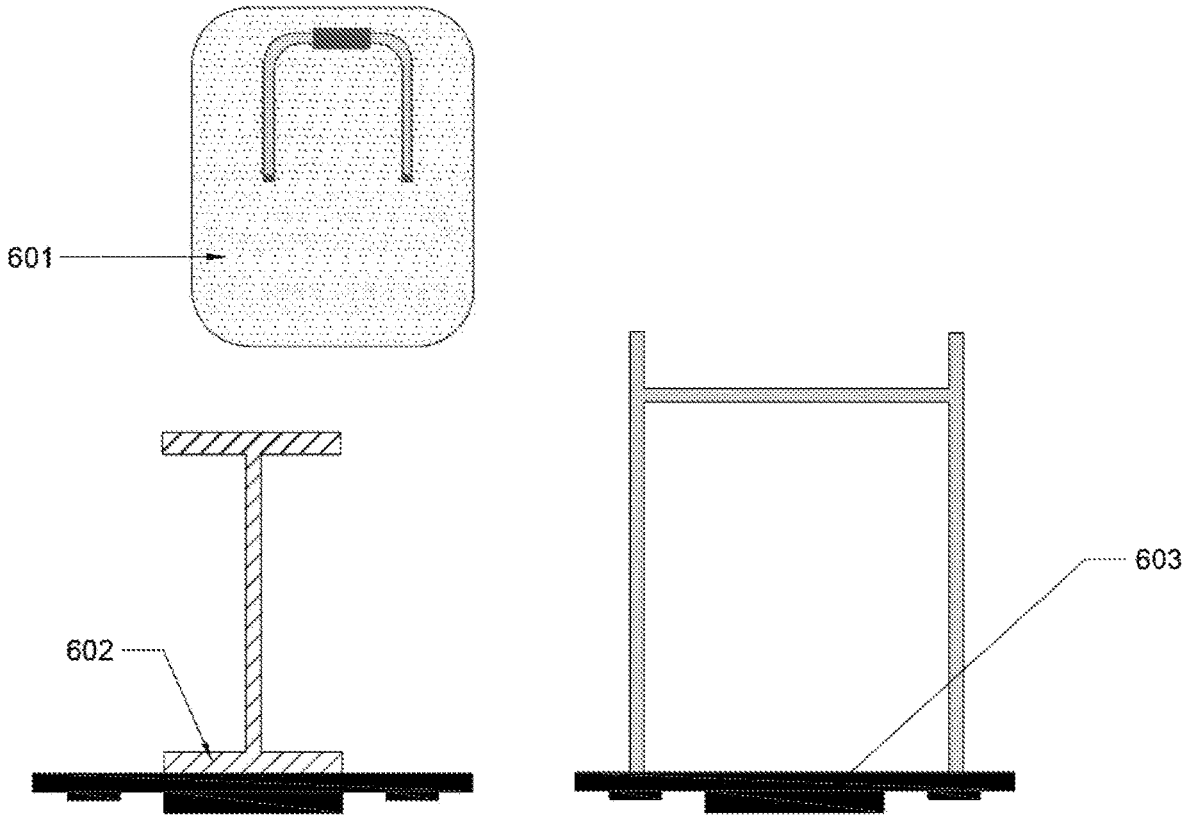
FIG. 6 illustrates various views of an embodiment of the apparatus using a stand with handlebars.
Figure 7:
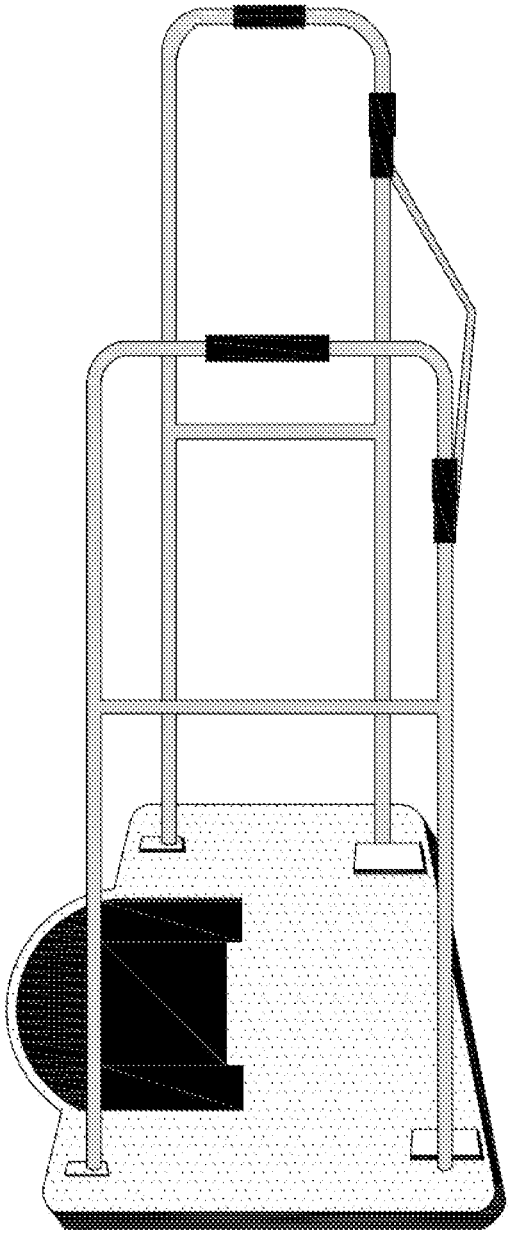
FIG. 7 illustrates the side isometric view of an embodiment of the apparatus.
Figure 8:
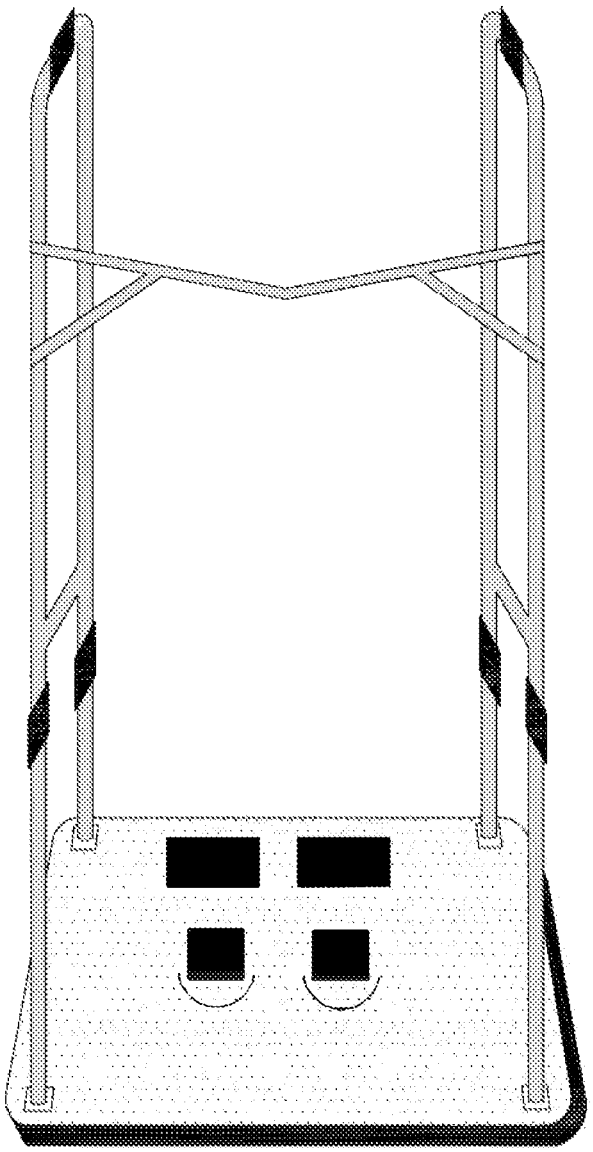
FIG. 8 illustrates the front isometric view of an embodiment of the apparatus.
Figure 9:
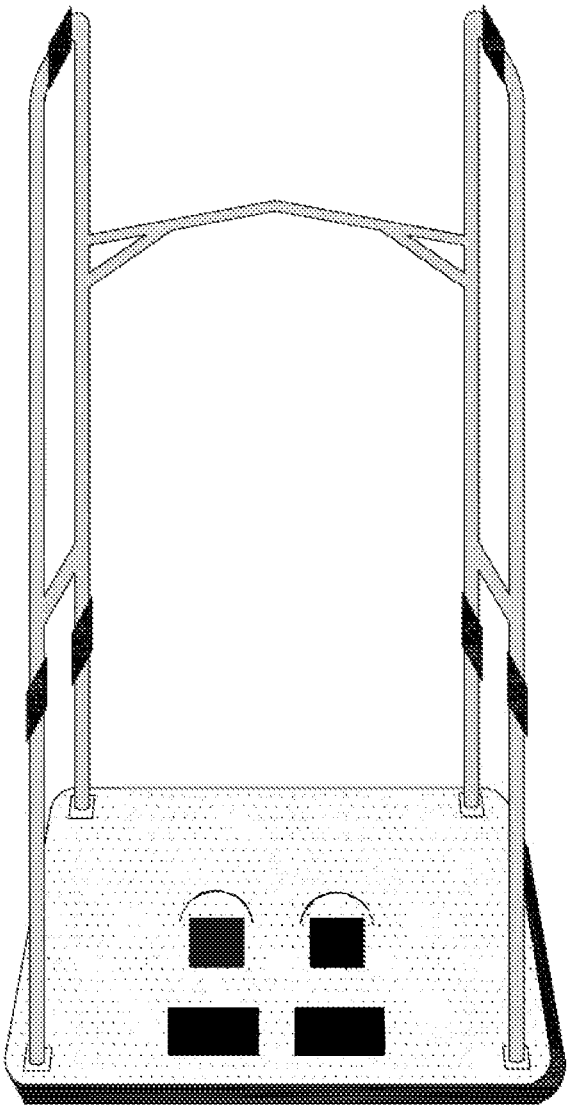
FIG. 9 illustrates the rear isometric view of an embodiment of the apparatus.

In another embodiment, shown in FIG. 6, the apparatus can include a stand with handles (602,603) as the stabilizing device. In such an embodiment, the height of the stand can be adjusted to account for individuals of various heights. 601 illustrates the top view of the apparatus that uses a stand with handles. In addition, the handles can vary in size in order to facilitate use of the apparatus where rotational space is limited.

The apparatus is light weight and collapses to make it compact. The apparatus comes with a handle which makes it portable and easy to carry from one place to another.

In some embodiments, the apparatus can hold a person of up to 250 pounds. In some embodiments, the apparatus can hold a person of up to 300 pounds. In some embodiments, the apparatus can hold a person of up to 350 pounds. In some embodiments, the apparatus can hold a person of up to 400 pounds. In some embodiments, the apparatus can hold a person of up to 450 pounds. In some embodiments, the apparatus can hold a person of up to 500 pounds or more.

In some embodiments, the total weight of the apparatus can be 10 pounds or less. In some embodiments the total weight of the apparatus can be 9 pounds or less. In some embodiments, the total weight of the apparatus can be 8 pounds or less. In some embodiments the total weight of the apparatus can be 7 pounds or less. In some embodiments the total weight of the apparatus can be 6 pounds or less. In some embodiments, the total weight of the apparatus can be 5 pounds or less.

In an embodiment where the stabilizing device is a walker, operation of the apparatus is as follows. The walker is coupled to the top surface of the base of the apparatus. The caregiver then aligns the opening of the walker with the individual with limited mobility. That individual then stands on the apparatus with the assistance of the caregiver and the walker. The caregiver then rotates the apparatus so that the individual is aligned with the second seating position. Finally, the individual sits in the second position with the assistance of the caregiver and the walker and is moved away from the apparatus.

Because the weight of the individual with limited mobility is primarily supported by the apparatus, the caregiver is no longer required to have nearly as much strength in order to assist the individual. This apparatus would be especially effective when used in a hospital, long-term care facility, or home care situation.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A portable movement assistance device comprising:

a) a base, wherein said base is configured with a plurality of non-stick supports attached to said base such that the non-stick supports contact the floor; and is sufficient in size to accommodate a walker, b) a platform, wherein the size of said platform is sufficient in size to accommodate a human using said walker;

c) a handle, wherein said handle is configured to accommodate the lifting and transfer of said device by a grip of a human hand; and d) a rotational component, wherein said rotational component contacts said base and said platform; and is configured to provide a rotational mechanism between said base and said platform; wherein said device is configured to rotate a human in a circular motion along a circular path.

2. The portable movement device of claim 1, wherein said device is configured to be portable from a first location to a second location.

3. The portable movement device of claim 1, wherein said device comprises wheels to move said device from a first location to a second location.

4. The portable movement device of claim 1, wherein said platform further comprises an anti-slip surface.

5. The portable movement device of claim 1, wherein said base is configured to stably accommodate a walker.

6. The portable movement device of claim 1, further comprising one or more engageable walker clasps that (1) when engaged are configured to clasp to a walker and immobilize the walker in a stationary position, and (2) when not engaged are configured to allow attachment or detachment of the walker from the base.

7. The portable movement device of claim 1, wherein said platform is configured to assist a person to rise from a first seated position to a standing position, rotate said person to a desired location and assist said person to a second seated position.

8. The portable movement device of claim 1, wherein said rotational component comprises a lazy Susan mechanism.

9. The portable movement device of claim 1, wherein said device can be rotated by a caregiver.

10. The portable movement device of claim 1, wherein said device can be transported by a caregiver.

11. The portable movement device of claim 1, wherein said handle is carved into said base.

12. The portable movement device of claim 1, wherein said base includes an outcropping configured to fit under a seated user.

* * * * *